US007837481B1

(12) United States Patent
Mahoney et al.

(10) Patent No.: US 7,837,481 B1
(45) Date of Patent: Nov. 23, 2010

(54) SOCKET FOR AN INTEGRATED CIRCUIT AND A METHOD OF PROVIDING A CONNECTION IN A SOCKET

(75) Inventors: David M. Mahoney, San Jose, CA (US); Mohsen Hossein Mardi, Saratoga, CA (US)

(73) Assignee: Xilinx, Inc., San Jose, CA (US)

( * ) Notice: Subject to any disclaimer, the term of this patent is extended or adjusted under 35 U.S.C. 154(b) by 278 days.

(21) Appl. No.: 12/008,847

(22) Filed: Jan. 14, 2008

(51) Int. Cl.
*H01R 12/00* (2006.01)

(52) U.S. Cl. ..... 439/81; 439/66

(58) Field of Classification Search ..... 439/68–73, 439/525, 66, 331, 824, 700, 81
See application file for complete search history.

(56) References Cited

U.S. PATENT DOCUMENTS 5,791,914 A * 8/1998 Loranger et al. ..... 439/71
6,181,149 B1 1/2001 Godfrey et al.
6,503,089 B2 * 1/2003 Saijo et al. ..... 439/70
6,541,991 B1 4/2003 Hornchek et al.
6,902,410 B2 * 6/2005 Watanabe ..... 439/66
7,199,599 B2 4/2007 Batara et al.
7,202,697 B1 4/2007 Kondapalli et al.

OTHER PUBLICATIONS

U.S. Appl. No. 12/233,015, filed Sep. 18, 2008, Mardi.

* cited by examiner

*Primary Examiner*—Edwin A. Leon
(74) *Attorney, Agent, or Firm*—John J. King

(57) ABSTRACT

A socket for an integrated circuit is disclosed. The socket comprises a main body portion having a plurality of holes extending between a top surface and a bottom surface; an overlay positioned adjacent to the main body portion and having a plurality of holes corresponding to the plurality of holes of the main body portion, wherein the overlay comprises a plurality of conductors between holes; and a plurality of contact elements positioned in predetermined holes of the main body portion. A method of providing a connection in a socket is also disclosed.

20 Claims, 8 Drawing Sheets

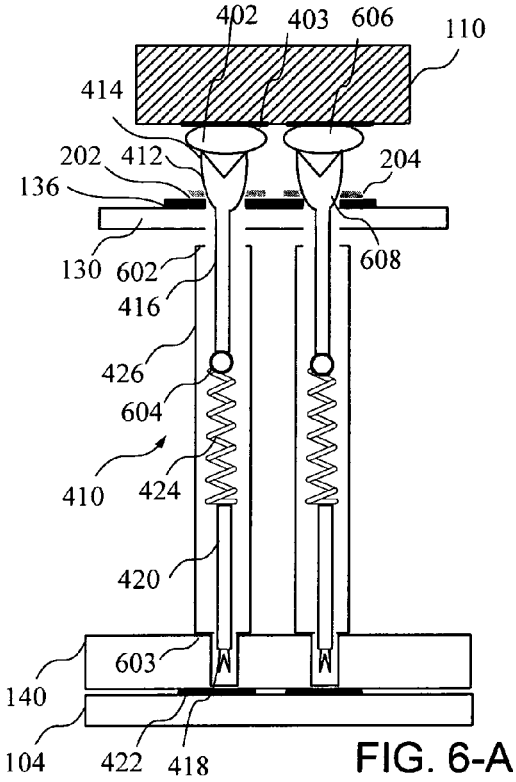
FIG. 6-A
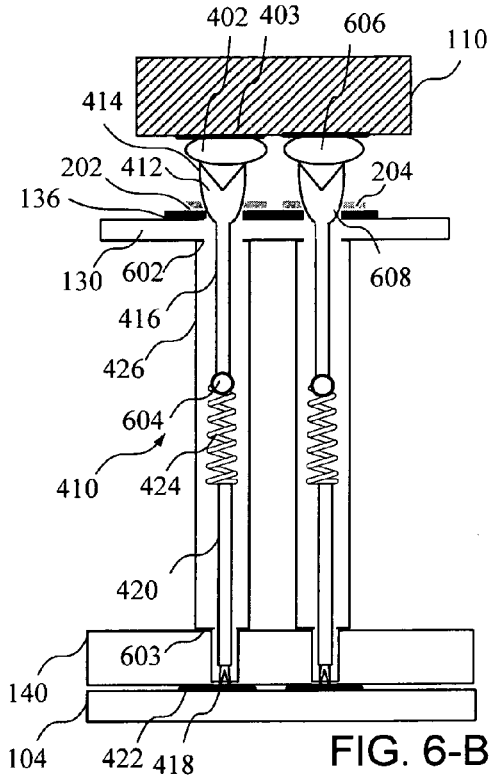
FIG. 6-B
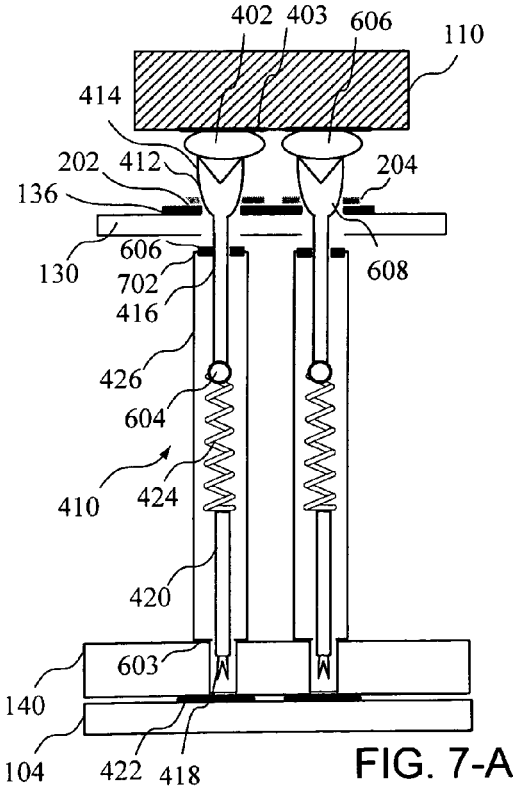
FIG. 7-A
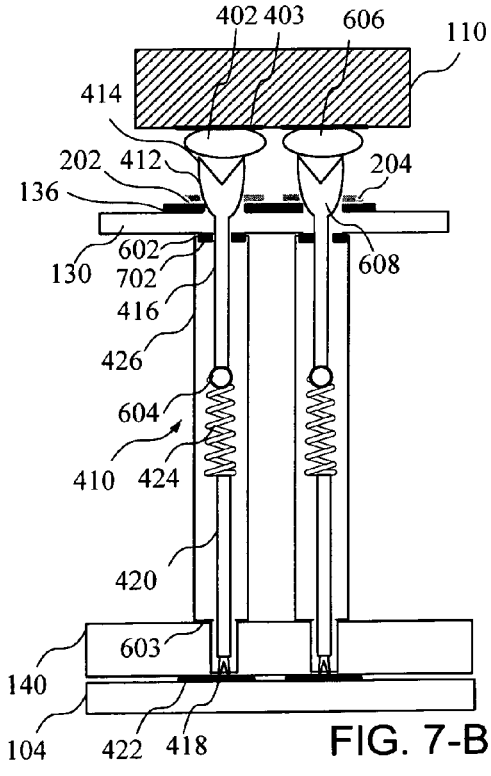
FIG. 7-B

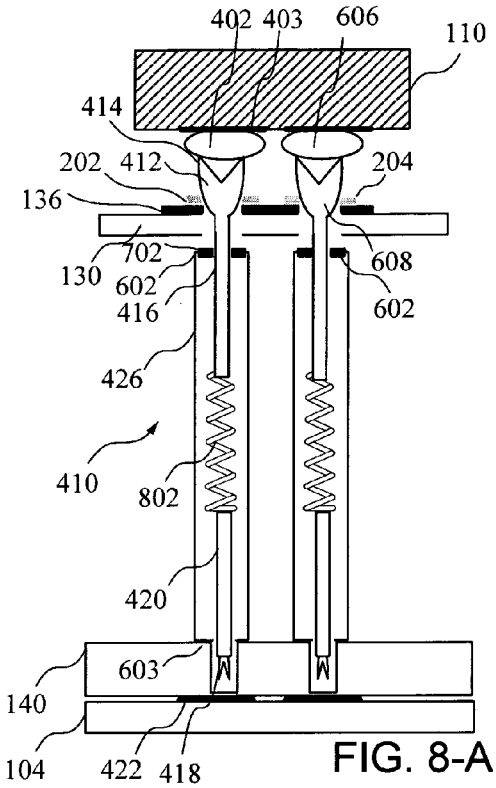
FIG. 8-A
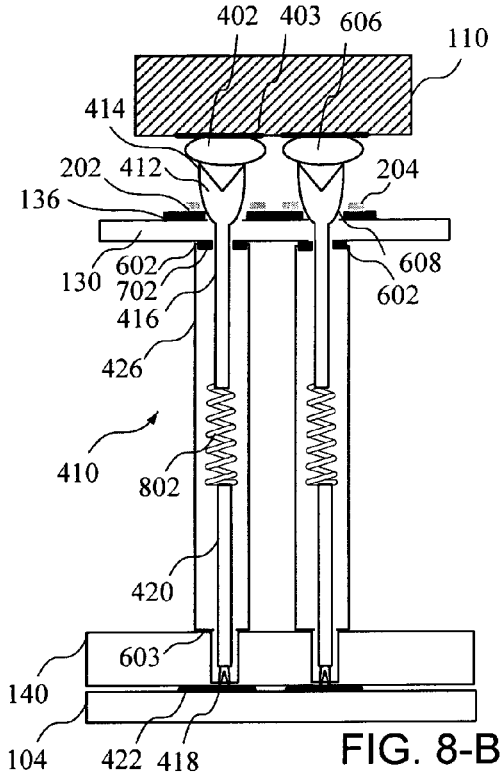
FIG. 8-B
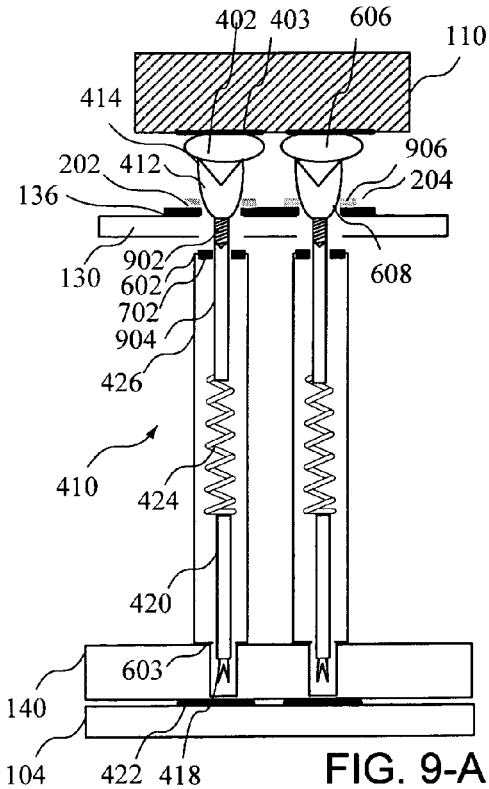
FIG. 9-A
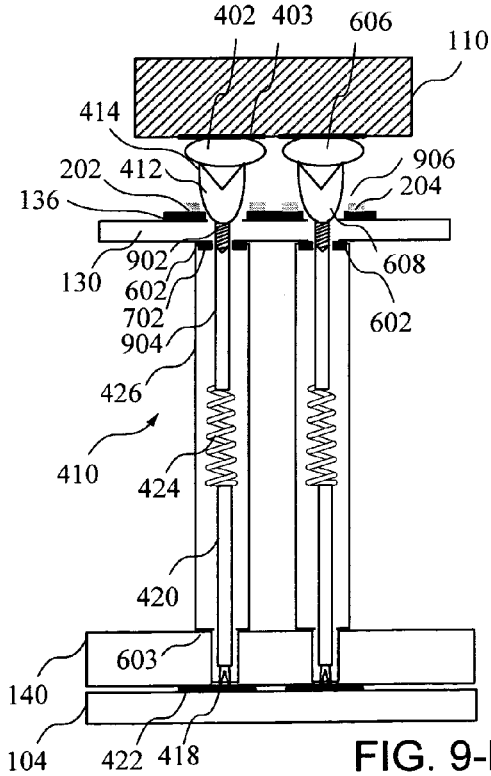
FIG. 9-B

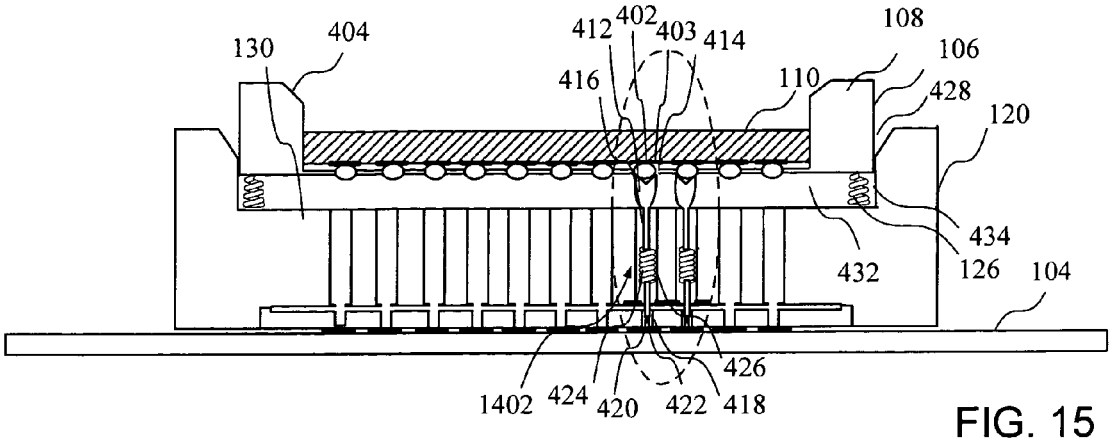
FIG. 15
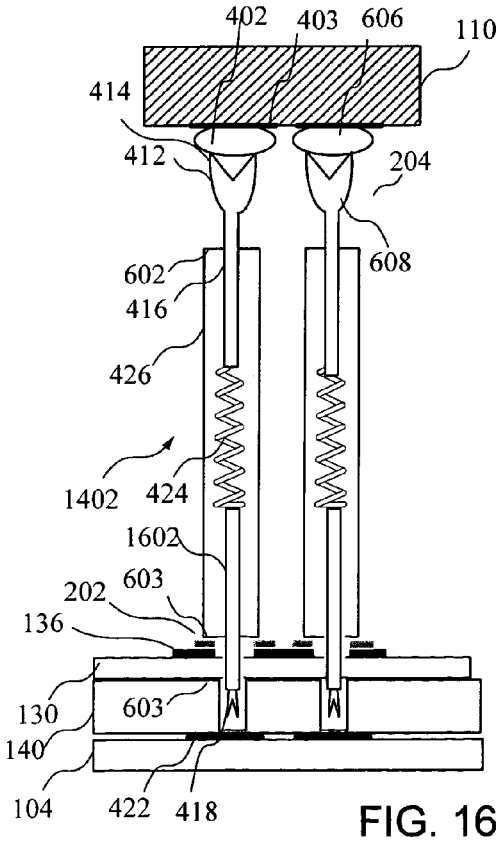
FIG. 16-A
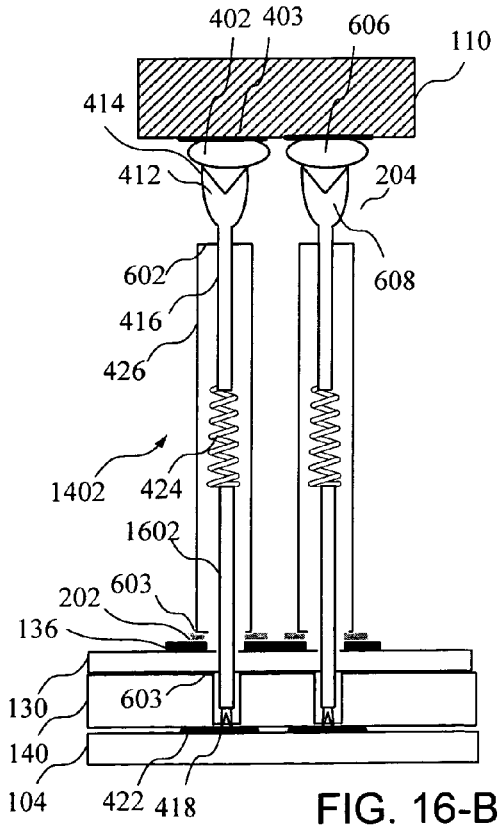
FIG. 16-B

SOCKET FOR AN INTEGRATED CIRCUIT AND A METHOD OF PROVIDING A CONNECTION IN A SOCKET

FIELD OF THE INVENTION

The present invention relates generally to integrated circuits, and in particular, to a socket for an integrated circuit and a method of providing a connection in a socket.

BACKGROUND OF THE INVENTION

An important step in the manufacture of integrated circuit is testing the packaged integrated circuit device prior to shipment to a customer. In the production of integrated circuits, it is important not only to determine whether a completed integrated circuit package is functioning properly, but to be able to test the integrated circuit packages at as low a cost as possible. Accordingly, any steps to improve the quality of and reduce the cost of testing integrated circuit packages are beneficial. The production testing of integrated circuit packages is performed using automated equipment such as handlers that load each of the devices into contactors or sockets on test boards, and then sort them based on the results. These sockets are designed to provide connections between the integrated circuit package and a Printed Circuit Board (PCB), and may comprise both a mechanical and electrical element. Further, as in selecting any component of a high volume test system for integrated circuit packages, it is important to minimize the cost of the test system. Accordingly, it is important to use standard components whenever possible to minimize the cost of testing.

Further, certain integrated circuit devices may provide different challenges during tests. For example, testing high speed devices, such data transceiver operating at high data rates, may be difficult. In particular, the additional length of the connectors/pogos of the socket may introduce noise, thereby reducing the speed at which the device may be tested. To test some of the I/O functionality in certain devices, such as data transceivers of the integrated circuit, some input and output ports of the integrated circuit device must be connected to each other. A socket for holding an integrated circuit comprises contact elements that are held in place by a package body and provide electrical connections between a packaged semiconductor device in the socket and a printed circuit board. This connection is made in conventional devices through contact elements of the socket which are connected by a conductive trace on the circuit board having the socket. However, noise generated on the contact elements of the socket may interfere with the high speed data transmission.

In some sockets, such as a socket for hosting a Ball Grid Array (BGA) package, the contact elements comprise flexible contact elements, often called pogo pins. For a BGA package having a plurality of solder balls on the bottom of the package, the mechanical aspect of the socket provides a certain amount of force to break through any oxide on the solder ball as well as provides a means to form an electrical connection. That is, in view of possible variations of solder balls of the package, flexible contact elements are provided to ensure that each contact element makes as sufficient connection to a solder ball. Accordingly, each of these contact elements has a working range or travel range which provides compensation for tolerances in the solder balls of the integrated circuit package. The contact element provides forces in both directions to make the electrical contact between a solder ball and a contact pad of the PCB. In order to provide the appropriate amount of force while maintaining the ability to compensation for the tolerances in the planarity of the package balls, it is necessary to maintain the over all length of the contact elements. Reducing the mechanical length of the contact element may impact the electrical contact between the integrated circuit device and the contact pads on the printed circuit board, and therefore affect the quality of the testing system.

Accordingly, there is a need for an improved socket for an integrated circuit and method of making a connection in a socket.

SUMMARY OF THE INVENTION

A socket for an integrated circuit is disclosed. The socket comprises a main body portion having a plurality of holes extending between a top surface and a bottom surface; an overlay positioned adjacent to the main body portion and having a plurality of holes corresponding to the plurality of holes of the main body, wherein the overlay comprises a plurality of conductors positioned between holes; and a plurality of contact elements positioned in predetermined holes of the plurality of holes of the main body portion. The overlay of the socket may comprise elastomeric gaskets on holes at opposite ends of a conductive trace of the overlay. At least one contact element of the plurality of contact elements may comprise a contact element providing an electrical connection between a solder ball of the integrated circuit and a conductor of the plurality of conductors between holes.

According to an alternate embodiment, a socket for an integrated circuit comprises a main body portion having a plurality of holes extending between a top surface and a bottom surface; an overlay positioned adjacent to the main body and having a plurality of holes corresponding to the plurality of holes of the main body portion, wherein the overlay comprises a plurality of conductors positioned between holes; and a plurality of contact elements positioned in the plurality of holes of the main body portion and extending into the plurality of holes of the overlay, wherein at least one contact element of the plurality of contact elements comprises a contact element providing an electrical connection between a solder ball of the integrated circuit and a conductor of the plurality of conductors between holes of the overlay. At least one contact element of the plurality of contact elements may comprise a contact element providing an electrical connection between a solder ball of an integrated circuit and a conductor of the plurality of conductors between holes and has a shorter electrical path than a contact element providing an electrical connection from a solder ball to a contact pad on a circuit board receiving the socket. Each contact element of the plurality of contact elements may comprise a spring-loaded pin, and at least one contact element of the plurality of spring-loaded pins may comprise an insulator between an upper contact and a flexible member.

A method of providing a connection in a socket for an integrated circuit is also disclosed. The method comprises providing a main body portion having a plurality of holes extending between a top surface and a bottom surface; positioning an overlay adjacent to the main body portion, the overlay having a plurality of holes corresponding to the plurality of holes of the main body portion and a plurality of conductors between holes; positioning a plurality of contact elements in the plurality of holes of the main body portion; and coupling solder balls of the integrated circuit in the socket by way of a short conductor of the plurality of conductors. Positioning an overlay on the top surface of the main body may comprise providing a conductive path above the main body between two solder balls of the integrated circuit. Coupling solder balls of the integrated circuit in the socket may comprise providing isolation between a contact of the contact element coupled to a solder ball of the integrated circuit and a contact pad of the circuit board receiving the socket.

BRIEF DESCRIPTION OF THE DRAWINGS

FIG. 6 shows cross-sectional views of spring-loaded contacts having a non-conductive body portion and an insulator above the spring, in non-compressed and compressed states, according to an embodiment of the present invention;

FIG. 7 shows cross-sectional views of spring-loaded contacts having an isolation ring at the top of the body portion and an insulator above the spring, in non-compressed and compressed states, according to an embodiment of the present invention;

FIG. 8 shows cross-sectional views of spring-loaded contacts having a non-conductive spring implemented in the socket, in non-compressed and compressed states, according to an embodiment of the present invention;

FIG. 9 shows cross-sectional views of spring-loaded contacts having a conductive portion and a non-conductive portion of an upper contact portion, in non-compressed and compressed states, according to an embodiment of the present invention;

FIG. 15 is a cross-sectional view of the socket of FIG. 14 which is compressed to make a connection between solder balls of the integrated circuit and contacts of the printed circuit board;

FIG. 16 shows cross-sectional views of spring-loaded contacts having a non-conductive lower contact according to an embodiment of the present invention;

DETAILED DESCRIPTION OF THE DRAWINGS

Figure 1:
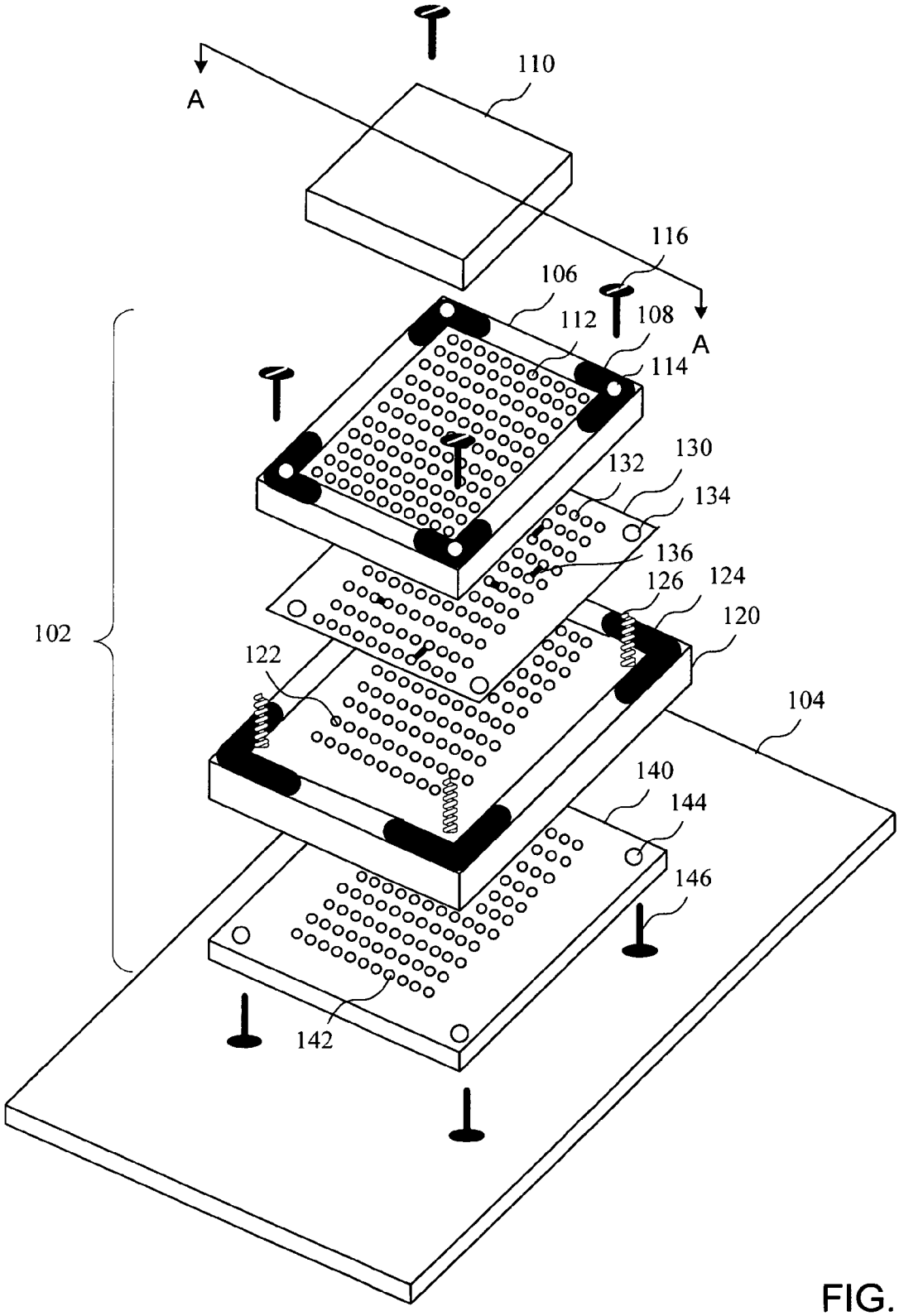
FIG. 1 is an expanded view of a socket receiving an integrated circuit and coupled to a circuit board according to an embodiment the present invention.

Turning first to FIG. 1, an expanded view of a socket receiving an integrated circuit and coupled to a circuit board according to an embodiment the present invention is shown. In particular, the socket 102 to be coupled to a circuit board 104 comprises a floating base 106 having corner portions 108 forming a recess for receiving an integrated circuit 110 and a plurality of holes 112. The integrated circuit may be a ball grid array (BGA) package having solder balls on the bottom which make contact with contact elements of the socket, as will be described in more detail below. The integrated circuit may be secured in the floating base 106 by a friction fit with the corner portions 108 or by some other mechanical attachment members. The floating base is coupled to the remaining portion of the socket by way of holes 114 on the corners and corresponding attachment members 116, such as screws. The floating base may be used in conjunction with spring-loaded contact elements during testing, as will be described in more detail below.

A main body portion 120 of the socket also comprises a plurality of holes 122 corresponding to the holes of the floating base 106. The plurality of holes 122 are adapted to receive contact elements having contacts on opposite ends to enable connections to both solder balls of the integrated circuit package 110 and contact pads of the circuit board 104. The main body portion 120 also comprises corner portions 124 which enable the floating base 106 to move vertically within the main body portion 120 in conjunction with springs 126, which may be on each corner of the main body portion, for example. As will be described in more detail below, the main body portion is shaped to enable the floating base to move in a vertical direction without moving in a horizontal direction. The springs may correspond to the holes 114 and held in place by the attachment member 116, or may be secured by some other attachment means at a different location on the main body portion.

According to one aspect of the invention, an overlay 130 having a plurality of holes 132 corresponding to the holes of the main body portion and the holes of the floating base is positioned between the integrated circuit and the main body portion, such as on a top portion of the main body portion. The overlay comprises a plurality of conductors 136 between holes. As will be described in more detail in reference to FIGS. 6-16, the conductors of the overlay may enable connections between solder balls on the integrated circuit having electrical contacts which is shorter than connections made with conventional pins which provide electrical connections to the circuit board 104. By using an overlay, standard components may be used for the remaining portion of the socket. Accordingly, the socket of the present invention overcomes the problems in testing high speed circuit, but may be implemented at a low cost. Depending upon the particular type of contact element used to make a connection between the solder balls on the integrated circuit and contacts or contact pads on the circuit board, a bottom portion 140 may be secured to the bottom of the main body portion 120 to secure the contact elements in the main body portion. In particular, holes 142 may correspond to holes in each of the floating base, the overlay and the main body portion, and may be sized to retain the contact elements within the main body portion. The contact element may be loaded from the top or bottom of the main body portion of the socket, depending upon the construction of the socket. While the bottom portion 140 acts as a retaining member for the contact elements, a retaining member may be used on the top surface of the main body portion, or two retaining members may be used to retain the contact elements within the socket. Further, as will be described in more detail below, the overlay may be positioned at another location within the socket adjacent to the main body portion, such as above the floating base or below the main body portion. The location of the overlay is shown between the floating base and the main body portion in FIG. 1 by way of example.

Figure 2:
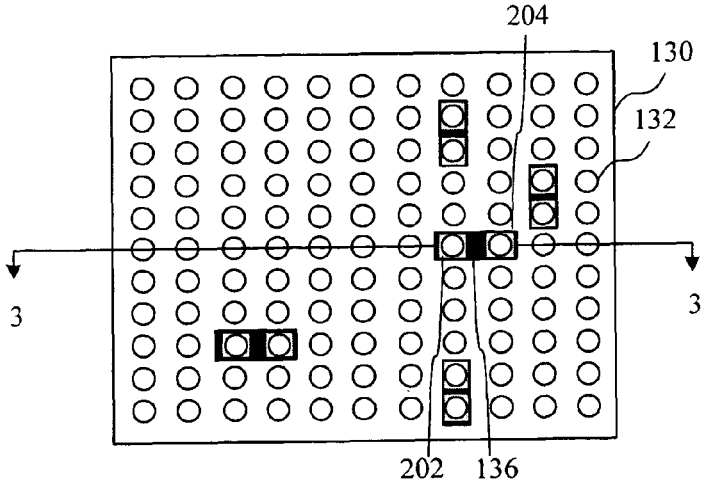
FIG. 2 is a top plan view of an overlay 130 used in the socket of FIG. 1 according to an embodiment of the present invention.
Figure 3:
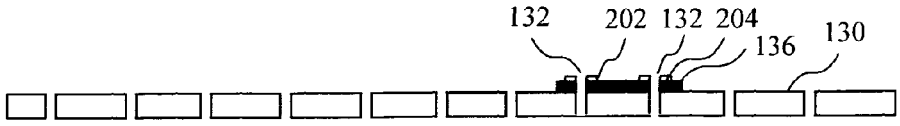
FIG. 3 is a cross-sectional view of the overlay 130 according to an embodiment of the present invention.

Turning now to FIG. 2, a top plan view of an example of an overlay 130 used in the socket of FIG. 1 according to one embodiment of the present invention is shown. For instance, the overlay 130 of FIG. 3 comprises the conductor 136 extending between two holes, and an elastomeric layer comprising contact elements 202 and 204 which enable an electrical connection between a portion of the contact element and the conductor 136 of the overlay. As shown in the cross-sectional view of the overlay 130 of FIG. 3, the contact elements comprise rings or gaskets enabling a portion of the contact to extend through the overlay while another portion makes contact to the elastomeric layer. The overlay 130 may comprise a flexible material, such as a polyimide film for example, while the conductor may be a copper trace on the overlay. The contact elements of the elastomeric layer comprise conductive materials to enable a connection between a solder ball of the integrated circuit and the conductor by way of a portion of a contact element. In addition to enabling the connection, the elastomeric layer provides additional flexibility in the socket to ensure sufficient electrical contacts to the solder balls of the integrated circuit. While the overlay of FIGS. 2 and 3 show one example of an insert which may be used in the socket, other configurations of an overlay and other materials to implement an overlay may be employed.

Figure 4:
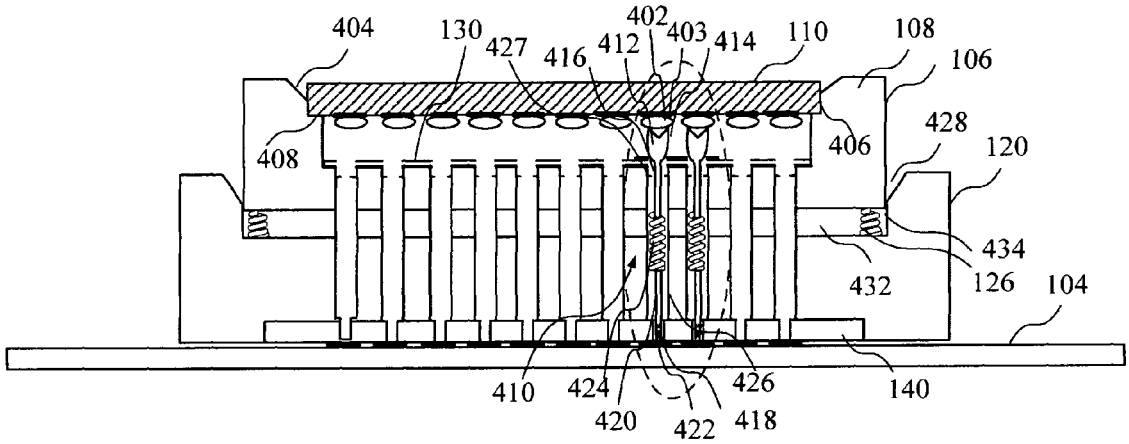
FIG. 4 is a cross-sectional view of the socket holding an integrated circuit package and having an overlay on the floating body according to an embodiment of the present invention.

Turning now to FIG. 4, a cross-sectional view of the socket holding an integrated circuit and coupled to a printed circuit board according to an embodiment of the present invention is shown. In particular, solder balls 402 on contact pads 403 of the integrated circuit package 110 are shown in a recess 404 of the floating base 106. The integrated circuit package may be held in place by friction fit with side walls 406 of the corner portions 108 and abut a shoulder portion 408 to provide a fixed location for the integrated circuit package within the floating base. A pair of contact elements is included by way of example to show the electrical connection between two solder balls of the integrated circuit package. A contact element 410 comprises an upper contact portion 412 having contact points 414. The contact points preferably have sharp edges to penetrate any oxide formed on the solder balls of the integrated circuit package. The upper contact portion has a diameter such that it will fit through the holes 112 of the floating body 106 and the holes 132 of the overlay (112 and 132 are not shown in FIG. 4). As will be visible in the expanded views of FIGS. 6-9, a flexible elastomeric contact portion will enable the upper contact portion to pass through a hole 132, while still enabling a contact when the socket is in a compressed state. The upper contact portion also comprises a shaft 416. A lower contact portion 418 extending from a shaft 420 makes contact with a contact pad 422 of the printed circuit board 104. Each of the shafts 416 and 420 are coupled to a flexible member 424, such as a spring, which enables the shafts and contact portions to move within the socket. A body portion 426 of the contact element 410 encapsulates the flexible member 424 and the shafts 416 and 420 within holes of the main body portion and the floating base.

Figure 5:
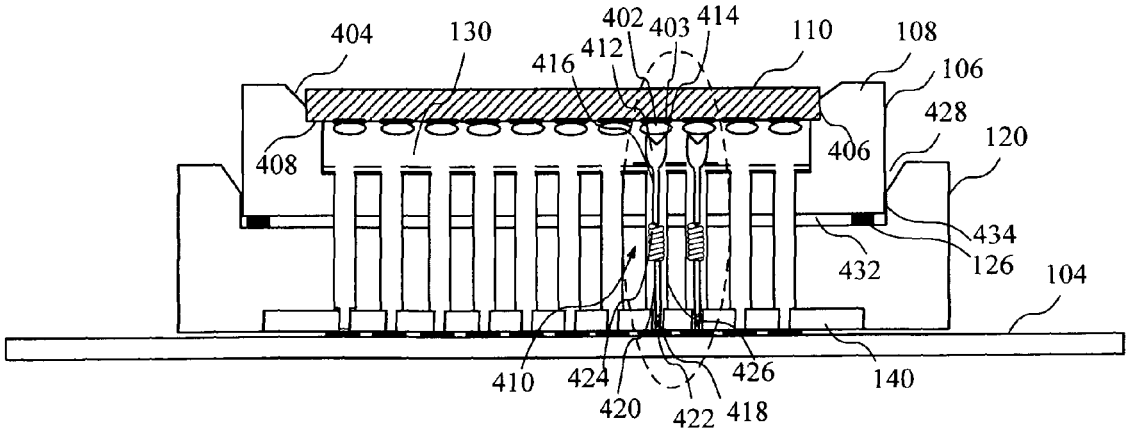
FIG. 5 is a cross-sectional view of the socket of FIG. 4 which is compressed to make a connection between solder balls of the integrated circuit and contacts of the printed circuit board.

As can be seen in FIG. 4, the floating base 106 is positioned within a recess 428 on springs 126, which define a gap 432 between the bottom of the floating head and the top surface of the main body within the recess 428. The springs 126 allow the floating base to move vertically within the recess 432, while side walls 434 maintain the orientation of the floating base in the horizontal position. As will be visible in FIG. 6-A described below, the upper contact portion 412 retains contact with the contact elements of the overlay 130 when it is positioned over the upper contact portions. That is, while the contact element 202 may be flexible enough to pass over the upper contact portions when the socket is assembled, the contact element will still provide an electrical connection to the upper contact element during operation of the socket when testing an integrated circuit. As shown in the cross-sectional view of FIG. 5, the socket of FIG. 4 is compressed to make a connection between solder balls of the integrated circuit and the printed circuit board. Downward pressure may be applied to the floating head and/or the integrated circuit package, causing the springs 126 to be compressed, thereby reducing the height of the gap 432. As is also shown in FIG. 5, the flexible member 424 of the contact element is compressed to provide the necessary pressure for making a sufficient contact to both a solder ball of the integrated circuit device/package and a contact pad of the circuit board. As will be described in more detail in reference to FIGS. 6-9 which show enlarged views of the contact elements 410 of FIGS. 4 and 5, specific designs of the contact elements reduce the electrical length of the contact between solder balls of the integrated circuit package connected by the conductor 136.

Turning now to FIG. 6, cross-sectional views of spring-loaded contacts having a non-conductive body portion and an insulator above the spring implemented in the socket in non-compressed and compressed states are shown. According to the embodiment of FIG. 6, the body portion 426 comprises a non-conduction body portion extending from a shoulder portion 602, which is moved upward relative to the overlay 130 when in the compressed state, to a foot portion 603 positioned on a surface of the bottom portion 140. The non-conductive body portion 426 and a non-conductive member 604 positioned between the shaft 416 and the flexible member 424, shown here as a ball, provide electrical isolation of the upper portion 412 of the contact element from the spring, the shaft 420 and the lower contact portion 418. The non-conductive body portion 426 and a non-conductive member 604 may be a plastic material, for example. By providing the electrical isolation, the electrical path between the solder ball 402 and a solder ball 606 through an upper portion 608 of a second contact element is significantly reduced. That is, unlike a conventional device where a path connecting solder ball 402 and solder ball 606 would extend through two contact elements 410 by way of a conductive trace on the circuit board, the conductive path extends from the solder ball 402 to solder ball 606 by way of the conductor 136 and contact elements 202 and 204. While the shafts 416 of the conductive elements may add some electrical length to the conductive path, it does not have a significant impact on the electrical performance of the circuit, but may also be eliminated as will be described in reference to FIG. 9 below. As in each of the remaining FIGS. 7-9 described below, FIG. 6-B shows the arrangement of a portion of the socket of FIG. 6-A in a compressed state, where the flexible member 424 is compressed, and the upper contact portion makes a connection to a solder ball of the integrated circuit package while the lower contact portion makes a connection to the contact pad 422.

Other variations of the contact elements providing electrical isolation may be employed based upon certain criteria, such as electrical characteristics, mechanical performance and cost, for example. As shown in the cross-sectional views of FIG. 7, the contacts elements have an isolation ring 702 at the shoulder 602 of the body portion and the insulator 604 above the spring. By providing the insulation ring 702, a metal body portion 426 may be used and still provide similar electrical performance to the embodiment of FIG. 6. As shown in the cross-sectional views of contact elements of FIG. 8, a plastic spring 802 may be employed to provide the necessary electrical isolation between the upper contact portion and the lower contact portion. Finally, as shown in the cross-sectional views of spring-loaded contacts of FIG. 9, the upper contact 412 comprises a threaded shaft 902 which is screwed into a non-conductive shaft 904. Accordingly, the electrical path between the solder ball 402 and the solder ball 606 does not include the shafts of the two contact elements, minimizing any electrical interference which may be caused by the shafts. The electrical connection between solder ball 402 and solder ball 606 of the embodiment of FIG. 9 is shown in detail in reference to FIG. 10. Although specific embodiments of contact elements providing electrical isolation are shown by way of example in FIGS. 6-9, other variations may be implemented to reduce the electrical length of connections within a socket according to the invention.

Figure 10:
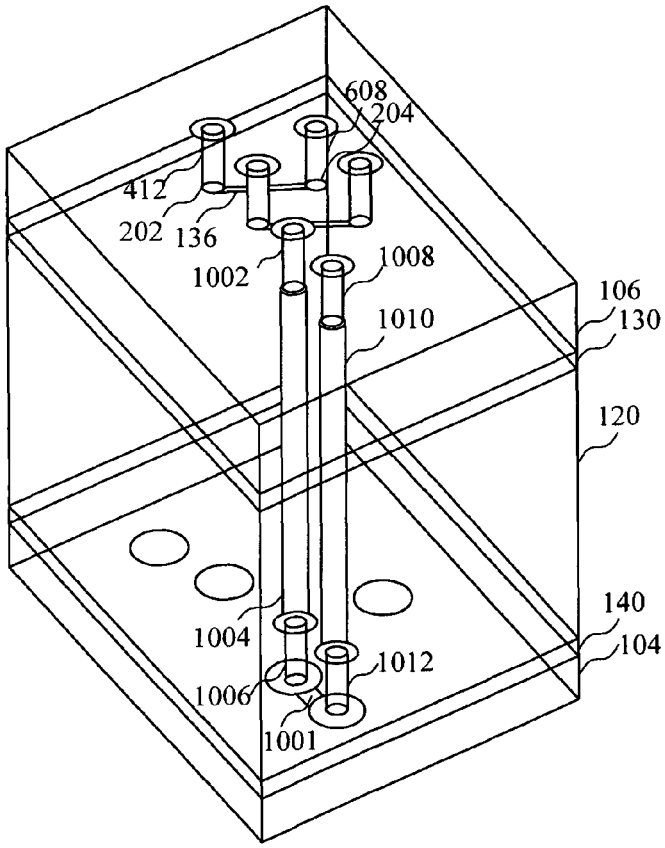
FIG. 10 is a three-dimensional cross-sectional view of a portion of a socket showing the electrical lengths of various conductive elements of the socket making connections between two solder balls of an integrated circuit according to an embodiment of the present invention.

Turning now to FIG. 10, a three-dimensional cross-sectional view of a portion of a socket showing the electrical lengths of various contact elements of the socket. For instance, the electrical path according to the embodiment of FIG. 9 comprises upper contact portion 412 of a first conductive element, conductor 136, and upper contact portion 608 of a second conductive element, where the elements are located above the main body portion. In contrast, the electrical length of a connection between two solder balls of an integrated circuit using a conventional socket would comprise the entire electrical lengths of two contact elements. For example, in addition to any trace on 1001 (and any vias leading to traces 1001) on the circuit board coupling the first and second contact elements, the electrical length of the connection would include an upper contact portion 1002, conductors within a body portion 1004, and a lower contact portion 1006 of a first contact element, and an upper contact portion 1008, conductors within a body portion 1010 and a lower contact portion 1012 of a second contact element.

Figure 11:
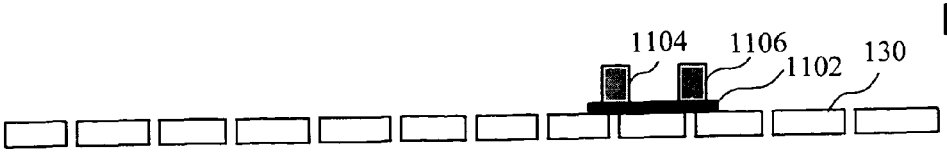
FIG. 11 is a cross-sectional view of the overlay 103 providing connections between solder balls of an integrated circuit according to an alternate embodiment of the present invention.

Turning now to FIG. 11, a cross-sectional view of the overlay 130 according to an alternate embodiment of the present invention is shown. While the embodiments of FIGS. 1-10 are particularly advantageous when testing BGA packages where a flexible contact element, such as a pogo pin, accommodates any variation in ball size of the solder balls of the package, other packages may not require flexible contact elements. For example, a line grid array (LGA), which is the same as a ball grid array but without the solder balls, would not have any variation in location of contact pads, and therefore would not require the flexible contact elements. Similarly, a quad flat package (QFP) having flexible contacts extending from the sides from the sides of the package may be tested without a need for flexible contact elements. Accordingly, an overlay 130 may comprise a conductor 1102 extending between two contact elements 1104 and 1106. The contact elements may also comprise a conductive elastomeric material. Because no contact elements are required in the holes of the main body portion where the conductor 1102 is located, it is not necessary to have holes in the conductor 1102 or the contact elements 1104 and 1106. Accordingly, no floating base 106 would be necessary in the embodiment of FIG. 11, and the integrated circuit package could be positioned directly above an overlay positioned on the main body portion.

Figure 12:
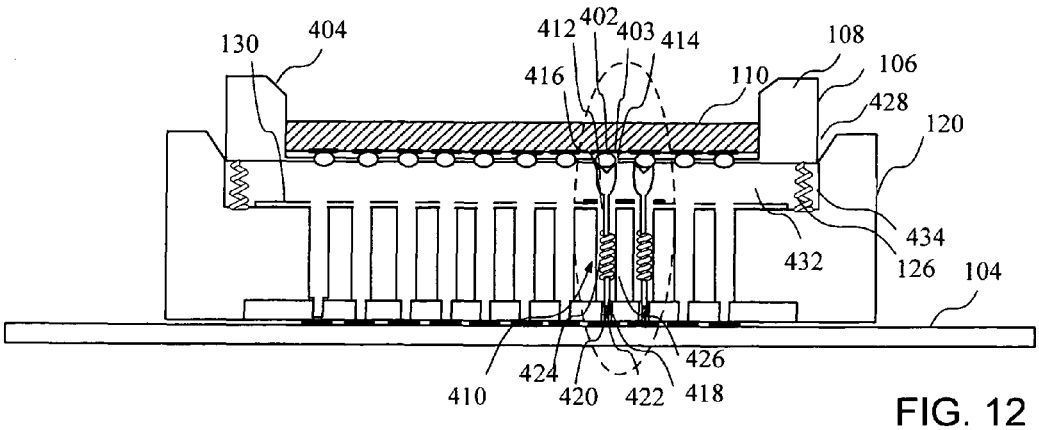
FIG. 12 is a cross-sectional view of a socket holding an integrated circuit package and having an overlay positioned on the main body according to an alternate embodiment of the present invention.
Figure 13:
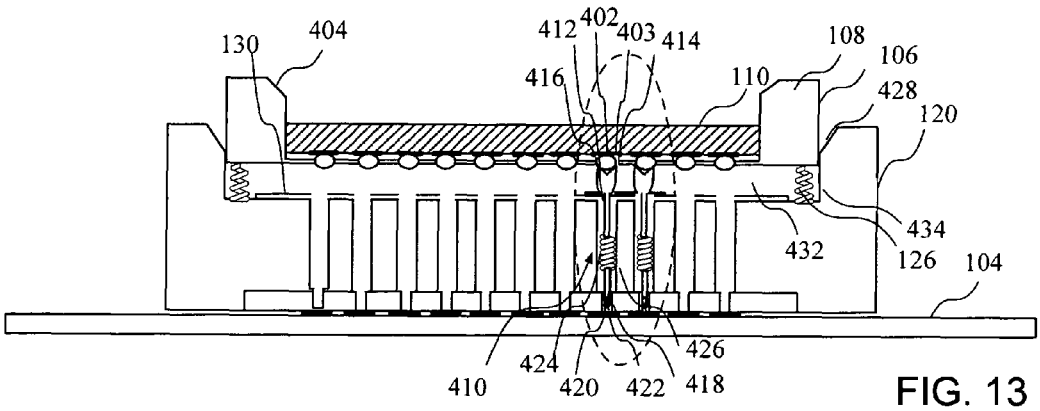
FIG. 13 is a cross-sectional view of the socket of FIG. 12 which is compressed to make a connection between solder balls of the integrated circuit and contacts of the printed circuit board.

Turning now to FIG. 12, a cross-sectional view of a socket holding an integrated circuit package and having an overlay positioned on the main body is shown. As shown in FIG. 12, the overlay 130 is provided within the recess 432 on a top surface of the main body 120. According to the embodiment of FIG. 12, the wholes 132 (not shown for simplicity) of the overlay must also be constructed to enable the overlay to be placed over the upper contact portions 412 while still maintaining contact with the upper contact portion when the floating base is moved to enable a contact to the solder bumps. As shown in the cross-sectional view of the socket of FIG. 13, the socket is compressed to make a connection between solder balls of the integrated circuit and contacts of the printed circuit board. As can be seen in FIG. 13, the upper contact portions of the contact elements 410 are in contact with the conductor 136 by way of the contact elements 202 as set forth above (136 and 202 are not shown for simplicity). It should be noted that the same contact elements of FIGS. 6-9 may be employed according to the embodiment of FIG. 12 to provide the necessary isolation. While the cross-sectional views of FIGS. 6-9 show upper contact element 412 in constant contact with the contact elements 202 of the overlay 130, where the overlay moves with the floating head according to the embodiment of FIG. 4, the overlay would be fixed with respect to the body portion 426, and the upper contact portion 412 would move into contact with the contact element 202 when the socket is moved to a compressed state according to the embodiments of FIGS. 12 and 13.

Figure 14:
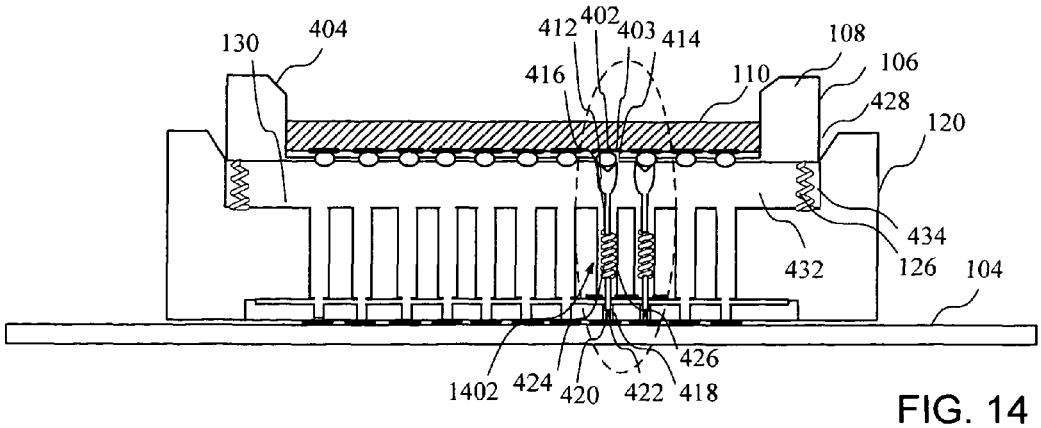
FIG. 14 is a cross-sectional view of a socket holding an integrated circuit package and having an overlay positioned below the main body according to an alternate embodiment of the present invention.

Turning now to FIG. 14, a cross-sectional view of a socket holding an integrated circuit package and having an overlay positioned below the main body is shown. For instance, the overlay is positioned below the main body portion 120, and particularly between the bottom of the main body portion and the bottom portion 140. As will be described in more detail in reference to FIG. 16, the body portion of a contact element 1402, which is in electrical contact with the upper contact element 412, is in electrical contact with the contact element 202 of the overlay 130. While the main body of the contact element is in contact with the contact element 202 when the socket is compressed, as well as when the socket is not compressed as shown in FIG. 15, the electrical length of the contact between the two solder balls is less when the socket is compressed, as shown in FIG. 15.

As shown in FIG. 16, an electric the shaft 416 is in electrical contact with the body portion 426, which in turn is in electrical contact with the contact element 202 of the overlay. While other isolation techniques may be employed, a non-conductive lower contact portion 1602 may be employed according to the embodiment of FIG. 16. For example, a non-conductive spring, or a non-conductive ball between the upper contact and the spring may be employed, as set forth above. In order to maintain the height of all of the contact elements which may be positioned in holes of the main body portion when positioning the overlay between the main body portion and the bottom portion, non-conductive standoff having the same height as the conductor 136 and the contact element 202 may be employed around other holes of the overlay. It should be noted that, while the positioning of the overlay as shown in FIG. 16 may not appear to provide much advantage in the electric length, a connection between contact pads on a circuit board receiving a conventional socket may be deep within the board and connected to the contact pads by vias, thereby greatly extending the electrical length of the connection.

Figure 17:
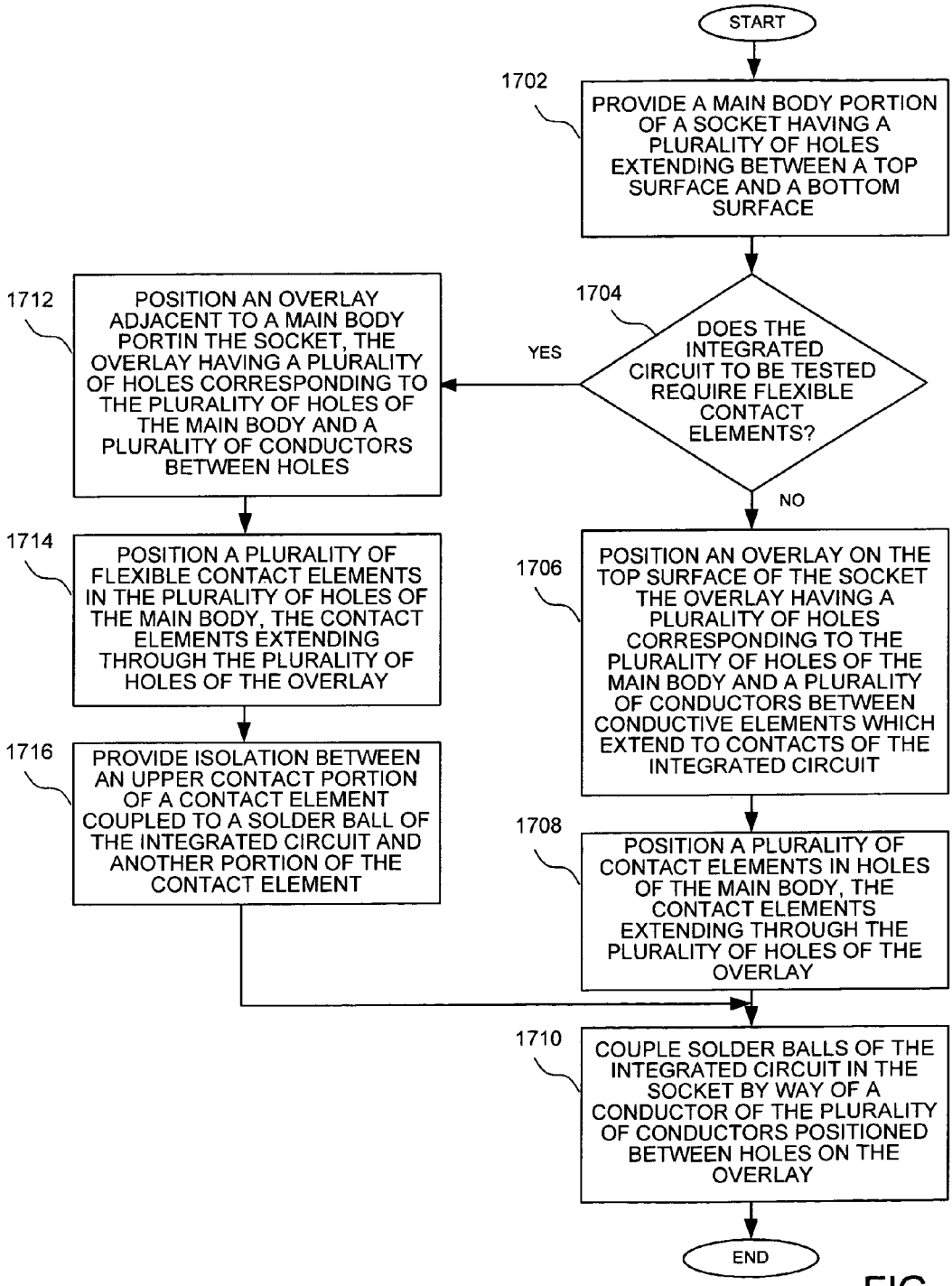
FIG. 17 is a flow chart showing a method of providing a connection in a socket according to an embodiment the present invention.

Finally, turning to FIG. 17, a flow chart shows a method of providing a connection in a socket according to an embodiment the present invention. The method of FIG. 17 may be implemented using any of the arrangements shown in FIGS. 1-16, or other suitable arrangements for providing a connection in a socket. In particular, a main body portion of a socket having a plurality of holes extending between a top surface and a bottom surface is provided at a step 1702. It is then determined whether the integrated circuit to be tested requires flexible contact elements at a step 1704. If not, an overlay is positioned on the top surface of the socket at a step 1706, where the overlay has a plurality of holes corresponding to the plurality of holes of the main body and a plurality of conductors between conductive elements which extend to contacts of the integrated circuit. For example, the overlay 130 of FIG. 11 may be employed on the top surface of the floating base 106 or the main body portion 120. A plurality of contact elements is then positioned in holes of the main body, where the contact elements extend through the plurality of holes of the overlay at a step 1708. A shorter electrical length is provided from a solder ball of the integrated circuit in the socket to another solder ball by way of a conductor on the overlay at a step 1710. If flexible contact elements are required, an overlay is positioned adjacent to a main body portion of the socket at a step 1712. For example, the overlay may be positioned as shown in FIG. 4, 12, or 14, for example. The overlay also has a plurality of holes corresponding to the plurality of holes of the main body and a plurality of conductors between holes. A plurality of flexible contact elements is then positioned in holes of the main body at a step 1714. The contact elements extend through the plurality of holes of the overlay, including holes which are coupled by a conductor on the overlay. Isolation is provided between an upper contact portion of a contact element coupled to a solder ball of the integrated circuit and another portion of the contact element at a step 1716. Accordingly, the flexible contact element will provide sufficient contact pressure to the solder balls of the integrated circuit package, while still providing electrical isolation necessary to reduce the electrical length when coupling two solder balls on the package.

It can therefore be appreciated that the new and novel socket for an integrated circuit and method of providing a connection in a socket has been described. It will be appreciated by those skilled in the art that numerous alternatives and equivalents will be seen to exist which incorporate the disclosed invention. As a result, the invention is not to be limited by the foregoing embodiments, but only by the following claims.

What is claimed is:

1. A socket for an integrated circuit, the socket comprising:

a main body portion having a plurality of holes extending between a top surface and a bottom surface;

an overlay positioned substantially parallel to the top surface of the main body portion and having a plurality of holes corresponding to the plurality of holes of the main body portion, wherein the overlay comprises a plurality of conductors positioned substantially parallel to the top surface of the main body portion and between holes of the overlay; and a plurality of contact elements positioned in predetermined holes of the plurality of holes of the main body portion.

2. The socket of claim 1 further comprising a base movably coupled to the main body portion, wherein the base comprises a plurality of holes corresponding to the plurality of holes of the main body portion.

3. The socket of claim 1 wherein each contact element of the plurality of contact elements comprises a spring-loaded pin adapted to extend between a solder ball of the integrated circuit and a contact pad on a printed circuit board receiving the socket, each spring-loaded pin providing force for making an electrical path between the solder ball of the integrated circuit and the contact pad of the printed circuit board.

4. The socket of claim 1 wherein the overlay comprises elastomeric conductive elements on holes at opposite ends of a conductive trace.

5. The socket of claim 1 wherein at least one contact element of the plurality of contact elements comprises a contact element providing an electrical path between a solder ball of the integrated circuit and a conductor of the plurality of conductors between holes of the overlay.

6. The socket of claim 5 wherein the contact element providing an electrical path between a solder ball of the integrated circuit to a conductor of the plurality of conductors between holes of the overlay comprises a contact element positioned between the solder ball of the integrated circuit and the conductor of the plurality of conductors of the overlay.

7. The socket of claim 2 wherein the overlay is positioned between the integrated circuit and the base.

8. A socket for an integrated circuit, the socket comprising:

a main body portion having a plurality of holes extending between a top surface and a bottom surface;

an overlay positioned substantially parallel to the top surface of the main body portion and having a plurality of holes corresponding to the plurality of holes of the main body portion, wherein the overlay comprises a plurality of conductors positioned substantially parallel to the top surface of the main body portion and between holes of the overlay; and a plurality of contact elements positioned in the plurality of holes of the main body portion and extending into the plurality of holes of the overlay, wherein at least one contact element of the plurality of contact elements comprises a contact element providing an electrical connection between a solder ball of the integrated circuit and a conductor of the plurality of conductors.

9. The socket of claim 8 wherein the at least one contact element of the plurality of contact elements has a shorter length than a contact element of the plurality of contact elements providing an electrical connection from a solder ball to a contact pad on a circuit board receiving the socket.

10. The socket of claim 9 wherein the shorter length comprises a shorter electrical path between the solder ball of the integrated circuit and the conductor of the plurality of conductors.

11. The socket of claim 8 wherein each contact element of the plurality of contact elements comprises a spring-loaded pin having an insulator between an upper contact and a lower contact.

12. The socket of claim 8 further comprising a floating base, the floating base comprising a plurality of holes corresponding to the plurality of holes of the overlay and receiving contact portions of the plurality of contact elements to enable electrical connections to solder balls of the integrated circuit.

13. The socket of claim 8 wherein the plurality of conductors on the overlay comprises printed conductive traces.

14. The socket of claim 12 wherein the overlay is positioned between the integrated circuit and the floating base.

15. A method of providing an electrical path in a socket for an integrated circuit, the method comprising:

providing a main body portion having a plurality of holes extending between a top surface and a bottom surface;

positioning an overlay substantially parallel to the top surface of the main body portion, the overlay having a plurality of holes corresponding to the plurality of holes of the main body portion and a plurality of conductors positioned substantially parallel to the top surface of the main body portion and between holes of the overlay;

positioning a plurality of contact elements in the plurality of holes of the main body portion; and coupling solder balls of the integrated circuit in the socket by way of a conductor of the plurality of conductors positioned between holes on the overlay.

16. The method of claim 15 wherein positioning an overlay substantially parallel to the main body portion comprises providing a conductive path above the main body portion between two solder balls of the integrated circuit.

17. The method of claim 15 wherein coupling solder balls of the integrated circuit in the socket comprises providing isolation between a contact of a contact element coupled to a solder ball of the integrated circuit and a contact pad of the circuit board receiving the socket.

18. The method of claim 17 wherein providing isolation between a contact of a contact element coupled to a solder ball of the integrated circuit and a contact pad of the circuit board receiving the socket comprises providing an insulator between an upper contact and a spring of a spring-loaded pin.

19. The method of claim 17 wherein providing isolation between a contact of a contact element coupled to a solder ball of the integrated circuit and a contact pad of the circuit board receiving the socket comprises providing isolation at the overlay.

20. The method of claim 19 wherein providing an overlay comprises providing elastomeric contacts at holes on opposite ends of a printed conductive trace of the overlay.

* * * * *